US011158227B2

(12) United States Patent
Yeh et al.

(10) Patent No.: US 11,158,227 B2
(45) Date of Patent: Oct. 26, 2021

(54) DISPLAY DEVICE AND WIRE COMPONENT

(71) Applicant: AU OPTRONICS CORPORATION, Hsin-Chu (TW)

(72) Inventors: Yen-Wei Yeh, Hsin-Chu (TW); Chin-Hsien Chou, Hsin-Chu (TW); Wei-Li Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/944,547

(22) Filed: Jul. 31, 2020

(65) Prior Publication Data

US 2021/0056881 A1 Feb. 25, 2021

(30) Foreign Application Priority Data

Aug. 22, 2019 (TW) ..... 108129987

(51) Int. Cl.
*G09G 3/20* (2006.01)

(52) U.S. Cl.
CPC ..... *G09G 3/20* (2013.01); *G09G 2290/00* (2013.01); *G09G 2300/0404* (2013.01)

(58) Field of Classification Search
CPC ..... G09G 2310/0286; G09G 2310/08; G09G 3/3266; G09G 2310/0267; G09G 2310/0283; G09G 3/3674; G09G 3/3677; G09G 3/20; G09G 2310/0205; G09G 2310/06; G09G 3/3659; G09G 5/18; G09G 2310/04; G09G 2310/0213
See application file for complete search history.

(56) References Cited

U.S. PATENT DOCUMENTS 5,872,563 A * 2/1999 Asada ..... G09G 3/3674 345/212
8,982,031 B2 3/2015 Hung et al.
9,087,492 B2 7/2015 Chang et al.
2013/0278567 A1* 10/2013 Chang ..... G06F 30/394 345/204
2016/0284294 A1* 9/2016 Dai ..... H04N 13/359
(Continued)

FOREIGN PATENT DOCUMENTS

CN 104793819 7/2015
TW 201344318 A 11/2013

OTHER PUBLICATIONS

TIPO has issued the Office Action for the corresponding Taiwan application dated Aug. 20, 2020.

*Primary Examiner* — Sanjiv D. Patel
(74) *Attorney, Agent, or Firm* — WPAT, PC

(57) ABSTRACT

A wire component includes a plurality of working signal lines and a plurality of transmitting lines. The working signal lines are configured to respectively provide a plurality of working signals to a driving circuit, and phases of the working signals at least partially lag each other sequentially. The transmitting lines are configured to respectively transmit the working signals, and a portion of the transmitting lines crosses the working signal lines. A first working signal line is configured to provide a first working signal; a second working signal line is configured to provide a second working signal; the first working signal immediately lags the second working signal, and the first working signal line and the second working signal line are arranged with another working signal line therebetween.

20 Claims, 11 Drawing Sheets

(56) References Cited

U.S. PATENT DOCUMENTS

| | | | | |
|---|---|---|---|---|
| 2017/0200420 | A1* | 7/2017 | No | G09G 3/3275 |
| 2019/0019461 | A1* | 1/2019 | Shi | G09G 3/3674 |
| 2019/0333597 | A1* | 10/2019 | Liu | G09G 3/20 |

* cited by examiner

DISPLAY DEVICE AND WIRE COMPONENT

BACKGROUND OF THE INVENTION

1. Field of the Invention

The invention generally relates to an electronic device. Particularly, the invention relates to a display device.

2. Description of the Prior Art

With the development of technology, display devices have been widely used in people's lives.

In general, the display device includes a gate driver, which is configured to generate gate signals according to working signals of different phases, so as to turn on switches of the pixel circuit row by row. The working signals are transmitted by multiple working signal lines and may interfere with each other due to the coupling effect, resulting in different charging time of the pixel capacitance, which leads to the problem of bright and dark lines.

SUMMARY OF THE INVENTION

It is an aspect of the invention to provide a display device. In an embodiment, the display device includes: a gate driver, a plurality of working signal lines, and a plurality of transmitting lines. The gate driver is configured to provide a plurality of gate signals to a plurality of pixel driving circuits according to a plurality of working signals, wherein phases of the working signals at least partially lag each other sequentially. The working signal lines are arranged substantially parallel to each other and configured to respectively provide the working signals. The transmitting lines are respectively connected between the working signal lines and the gate driver and configured to transmit the working signals to the gate driver, wherein a portion of the transmitting lines crosses the working signal lines. A first working signal line of the working signal lines is configured to provide a first working signal of the working signals; a second working signal line of the working signal lines is configured to provide a second working signal of the working signals; the first working signal immediately lags the second working signal, and the first working signal line and the second working signal line are arranged with another working signal line of the working signal lines therebetween.

It is another aspect of the invention to provide a wire component. In an embodiment, the wire component includes a plurality of working signal lines and a plurality of transmitting lines. The working signal lines are configured to respectively provide a plurality of working signals to a driving circuit, wherein phases of the working signals at least partially lag each other sequentially. The transmitting lines are configured to respectively transmit the working signals, wherein a portion of the transmitting lines crosses the working signal lines. A first working signal line of the working signal lines is configured to provide a first working signal of the working signals; a second working signal line of the working signal lines is configured to provide a second working signal of the working signals; the first working signal immediately lags the second working signal, and the first working signal line and the second working signal line are arranged with another working signal line of the working signal lines therebetween.

It is yet another aspect of the invention to provide a display device. In an embodiment, the display device includes: a plurality of working signal lines and a plurality of transmitting lines. The working signal lines are configured to respectively provide a plurality of working signals to a driving circuits, wherein phases of the working signals at least partially lag each other sequentially. The transmitting lines are configured to respectively transmit the working signals, wherein a portion of the transmitting lines crosses the working signal lines. A first working signal line of the working signal lines is configured to provide a first working signal of the working signals; a second working signal line of the working signal lines is configured to provide a second working signal of the working signals; the phases of the first working signal and the second working signal are the same, and the first working signal line and the second working signal line are arranged with another working signal line of the working signal lines therebetween.

Through the above embodiments, the interference between the working signals can be reduced, and the problem of bright and dark lines can be alleviated.

DETAILED DESCRIPTION OF THE PREFERRED EMBODIMENT

Figure 1:
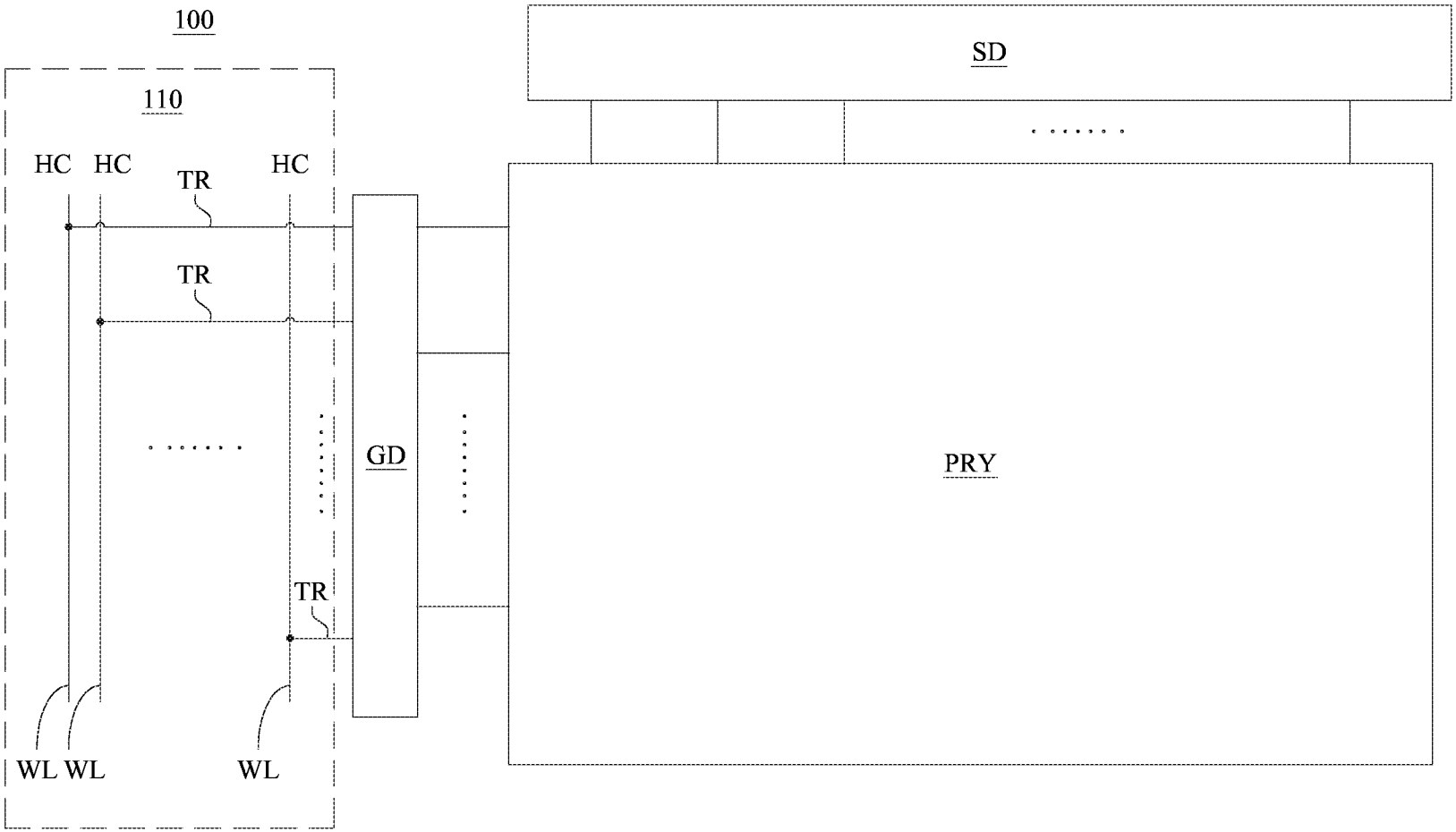
FIG. 1 is a schematic view of an embodiment of the display device of the invention.

The spirit of this disclosure will be clearly illustrated in the following figures and detailed descriptions. Further modification of the invention herein disclosed will occur to those skilled in the respective arts and all such modifications are deemed to be within the scope of the disclosure.

It should be understood that, even though the terms such as "first", "second", . . . , may be used to describe an element or an operation in the present specification, but these elements or operations are not limited by such terms. Such terms are merely used to differentiate an element or an operation from another element or operation.

As used herein, "electrically coupling" may refer to two or more elements directly physically or electrically contacted each other or indirectly physically or electrically contacted each other. Moreover, "electrically coupling" may refer to the interoperation or action of two or more elements.

As used herein, "comprising", "including", "having", or "containing" is an open term, which means including but not limited to.

As used herein, "and/or" includes any or all of the elements described.

The relative terms such as "upper", "lower", "left", "right", "front", or "rear" may be used herein to describe the relationship of one element to another, as illustrated. It will be understood that the relative terms are intended to encompass different orientations of the device in addition to the orientation shown in the drawings.

The terms "about", "approximate" or "essentially" as used herein include the value itself and the average values within the acceptable range of deviation of the specific values, considering the specific measurement discussed and the amount of errors related to such measurement.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

FIG. 1 is a schematic view of an embodiment of the display device 100 of the invention. In this embodiment, the display device 100 includes a wire component 110, a pixel matrix PRY, a source driver SD, and a gate driver GD. In this embodiment, the wire component 110 includes a plurality of working signal lines WL and a plurality of transmitting lines TR. In this embodiment, the working signal lines WL are arranged substantially parallel to each other and configured to provide working signals HO. The transmitting lines TR are respectively connected between the working signal lines WL and the gate driver GD and configured to transmit the working signals HO to the gate driver GD. In this embodiment, a portion of the transmitting lines TR crosses the working signal lines WL. In an embodiment, the transmitting lines TR are arranged substantially parallel to each other. In an embodiment, the transmitting lines TR are substantially perpendicular to the working signal lines WL.

In this embodiment, the gate driver GD is configured to provide the gate signals to a plurality of pixel driving circuits of the pixel matrix PRY according to the working signals HO to turn on switches of the pixel driving circuits row by row. The source driver SD is configured to receive the grayscale signal and provide data voltage to the pixel driving circuits according to the grayscale signal, so that the pixel driving circuits perform display in response to the data voltage.

Figure 2:
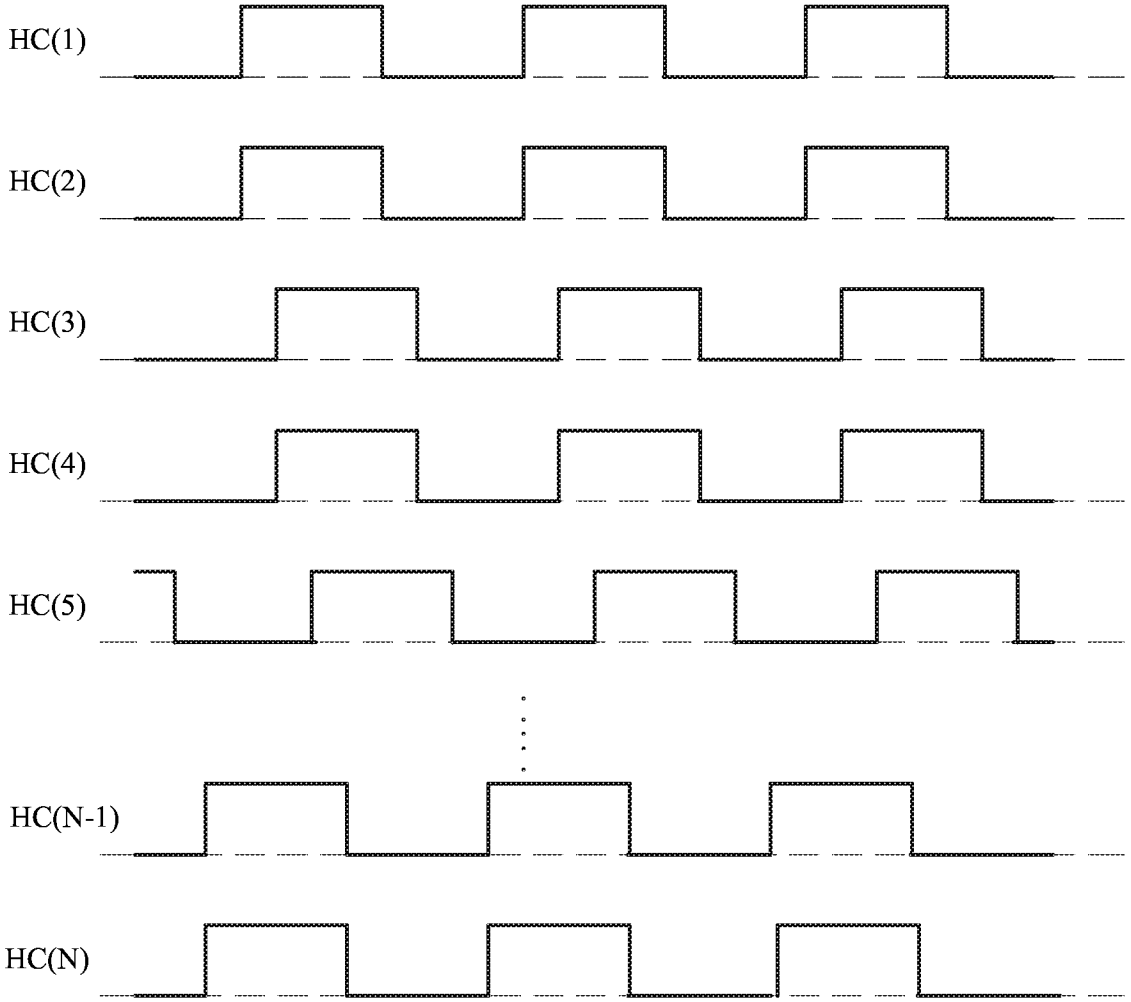
FIG. 2 is a waveform diagram of an embodiment of the working signal of the invention.

In an embodiment, the working signals HC include working signals HC(1) to HC(N). In an embodiment, the working signals HC(1) to HC(N) are substantially same in waveform. In an embodiment, phases of the working signals HC at least partially lag each other sequentially. For example, referring to FIG. 2, the phases of the working signals HC(3) and HC(4) immediately lag the phases of the working signals HC(1) and HC(2), the phase of the working signal HC(5) immediately lags the phases of the working signals HC(3) and HC(4), and the phases of the working signals HC(N−1) and HC(N) immediately lag the phase of the working signal HC(5). In this embodiment, every two working signals of the working signals HC(1) to HC(N) are sequentially same in phase. For example, the phases of the working signals HC(1) and HC(2) are the same, the phases of the working signals HC(3) and HC(4) are the same, and the phases of the working signals HC(N−1) and HC(N) are the same. From another aspect, the working signals HC(1) to HC(N) are sequentially arranged in groups for every two working signals, and the phases of the working signals lag each other sequentially group by group. Accordingly, in the above embodiment, there are N/2 different phases in the working signals HC(1) to HC(N).

Figure 3:
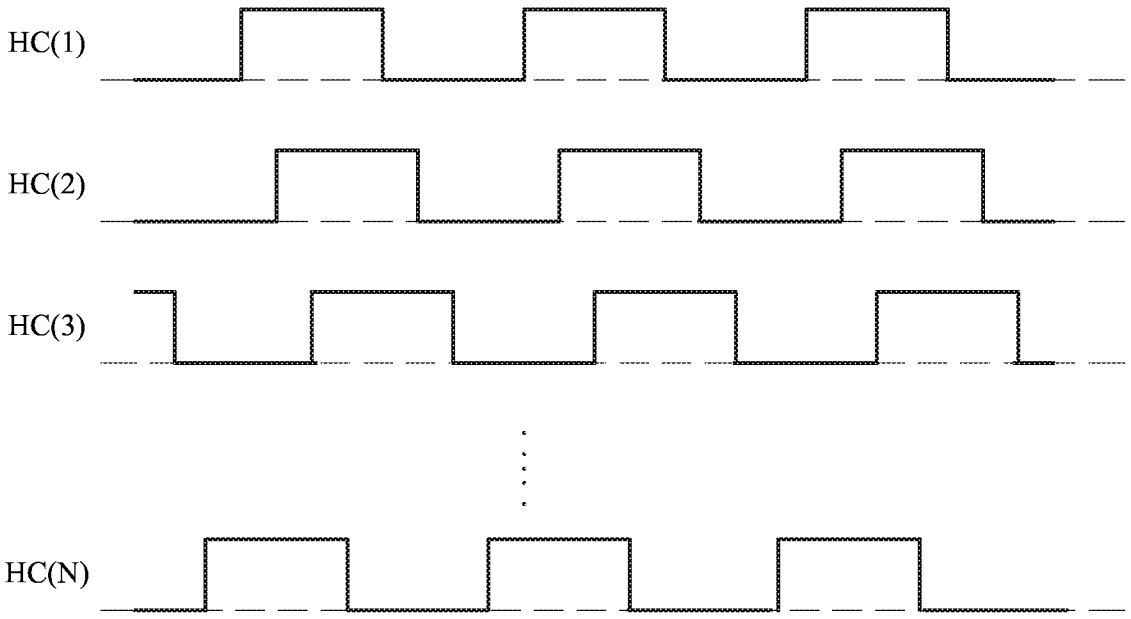
FIG. 3 is a waveform diagram of another embodiment of the working signal of the invention.

In another embodiment, referring to FIG. 3, the phase of the working signal HC(2) immediately lags the phase of the working signal HC(1), the phase of the working signal HC(3) immediately lags the phase of the working signal HC(2), and the phase of the working signal HC(N) lags the phase of the working signal HC(3). In this embodiment, the phases of the working signals HC(1) to HC(N) immediately lag each other sequentially. In other words, the phases of the working signals HC(1) to HC(N) are different from each other, the working signals HC(1) to HC(N) have the same pulse width, and each working signal has a time delay with respect to the previous one working signal. Accordingly, in the above embodiment, there are N different phases in the working signals HC(1) to HC(N), respectively.

Figure 4:
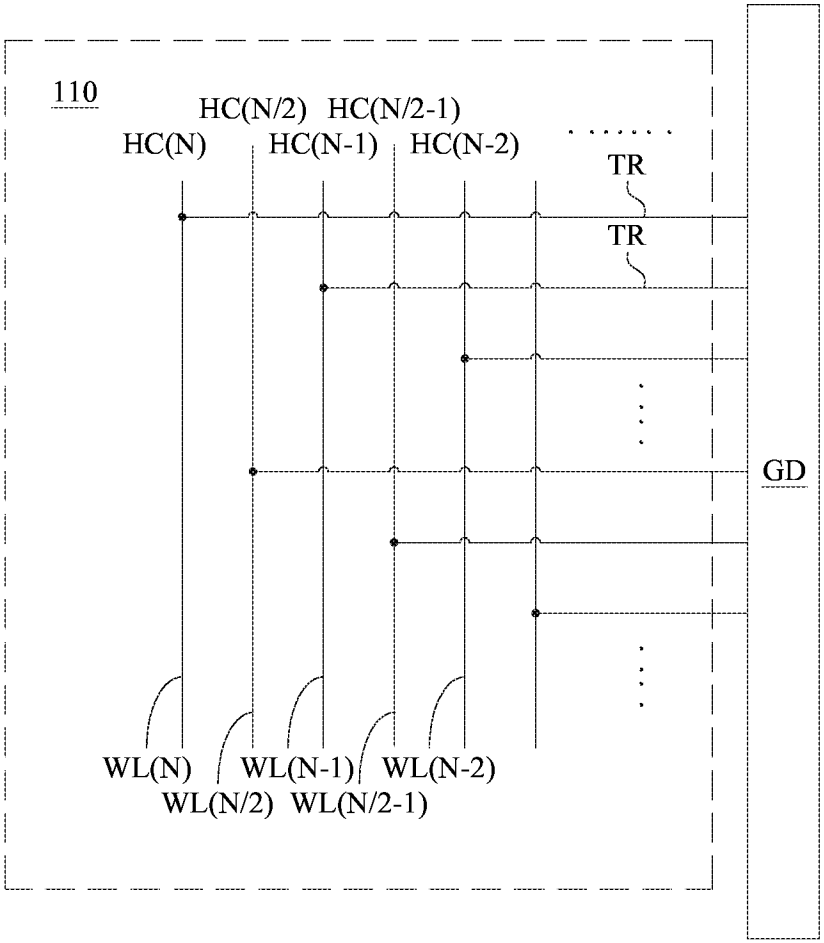
FIG. 4 is a schematic view of an embodiment of the wire component of the invention.

Referring to FIG. 4, in an embodiment, the working signal lines WL includes working signal lines WL(1) to WL(N), which provide the working signals HC(1) to HC(N), respectively. In this embodiment, the working signal lines WL(1) to WL(N) are separately arranged (non-sequentially arrangement) to reduce the interference between the working signals HC(1) to HC(N).

Figure 5:
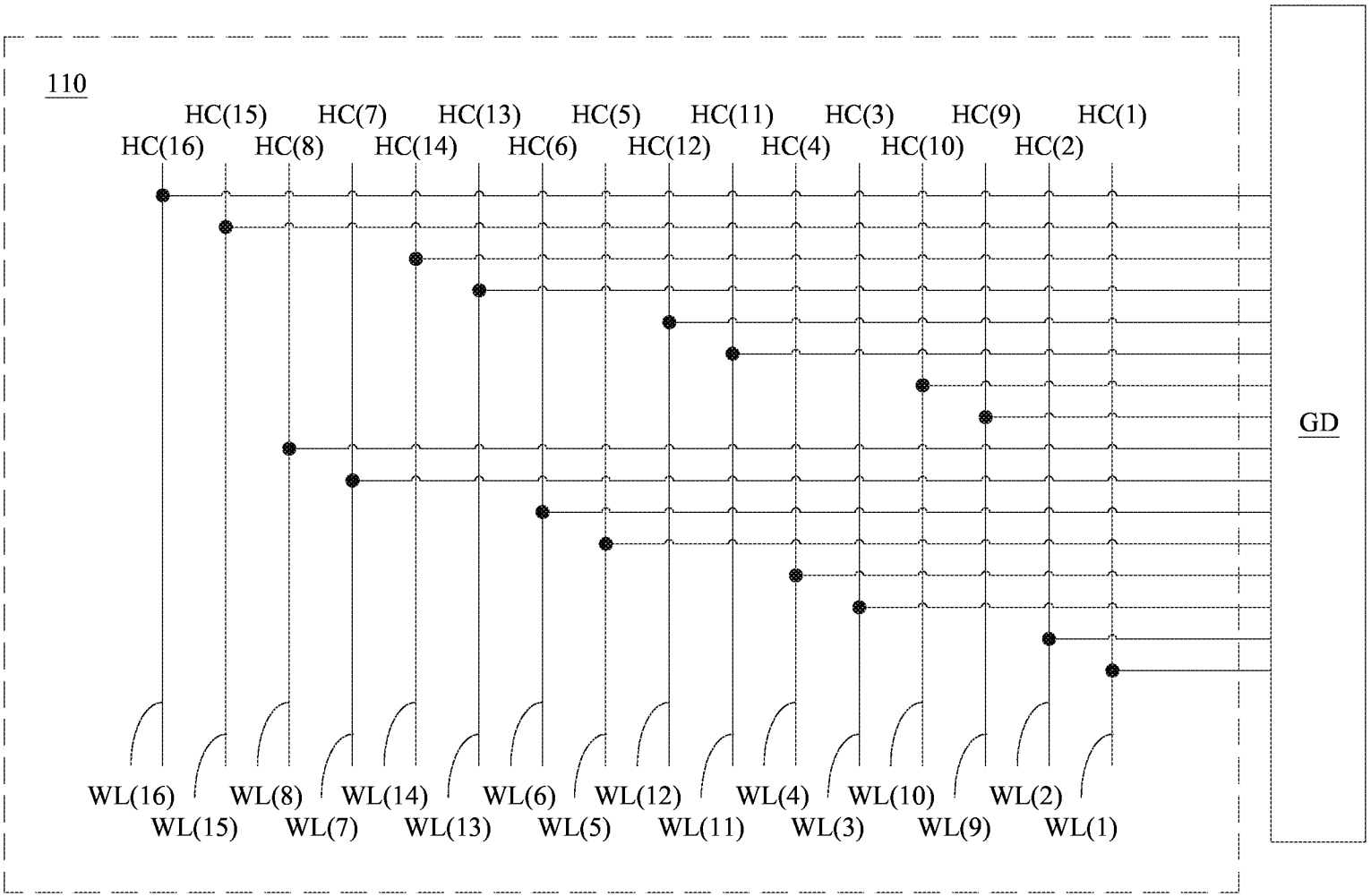
FIG. 5 is a schematic view of an embodiment of the wire component of the invention.

In the embodiment of FIG. 5, for example, the phase of the working signal HC(15) provided by the working signal line WL(15) immediately lags the phase of the working signal HC(14) provided by the working signal line WL(14), and the working signal line WL(15) and the working signal line WL(14) are separated with the working signal lines WL(8) and WL(7) arranged therebetween. Similarly, the phase of the working signal HC(7) provided by the working signal line WL(7) immediately lags the phase of the working signal HC(6) provided by the working signal line WL(6), and the working signal line WL(7) and the working signal line WL(6) are separated with the working signal lines WL(14) and WL(13) arranged therebetween.

In an embodiment, in the case that every two working signals of the working signals HC(1) to HC(N) are sequentially same in phase (as the configuration shown in FIG. 2), the two working signal lines, whose phases immediately lag each other, such as the working lines WL(15) and WL(14), the working lines WL(7) and WL(6), are arranged with another two working signal lines therebetween, i.e., separated by another two working signal lines.

Moreover, in the case that every two working signals of the working signals HC(1) to HC(16) are sequentially same in phase (as the configuration shown in FIG. 2), the phases of the working signals HC(16) and WL(15) are the same, the phases of the working signals HC(8) and HC(7) are the same, and the phases of the working signal HC(16) and HC15) are substantially opposite to the phases of the working signal HC(8) and HC(7). As such, by arranging the working signal lines WL(15) and WL(8) next to each other, the coupling effect of the working signals HC(1) to HC(16) can be reduced.

In the embodiment of FIG. 5, the working signal lines WL(1) and WL(2) are arranged neighboring the gate driver GD, and the working signal lines WL(16) and WL(15) are arranged far away from the gate driver GD, but not limited thereto. In another embodiment, as shown in FIG. 6, the working signal lines WL(1) and WL(2) can be arranged far away from the gate driver GD, and the working signal lines WL(16) and WL(15) are arranged neighboring the gate driver GD.

In some cases, the 16 working signal lines are sequentially arranged from near to far or from far to near with respect to the gate driver GD. With such a configuration, the standard deviation calculated by the ratio of fall time between the working signals is 9.66%.

Figure 6:
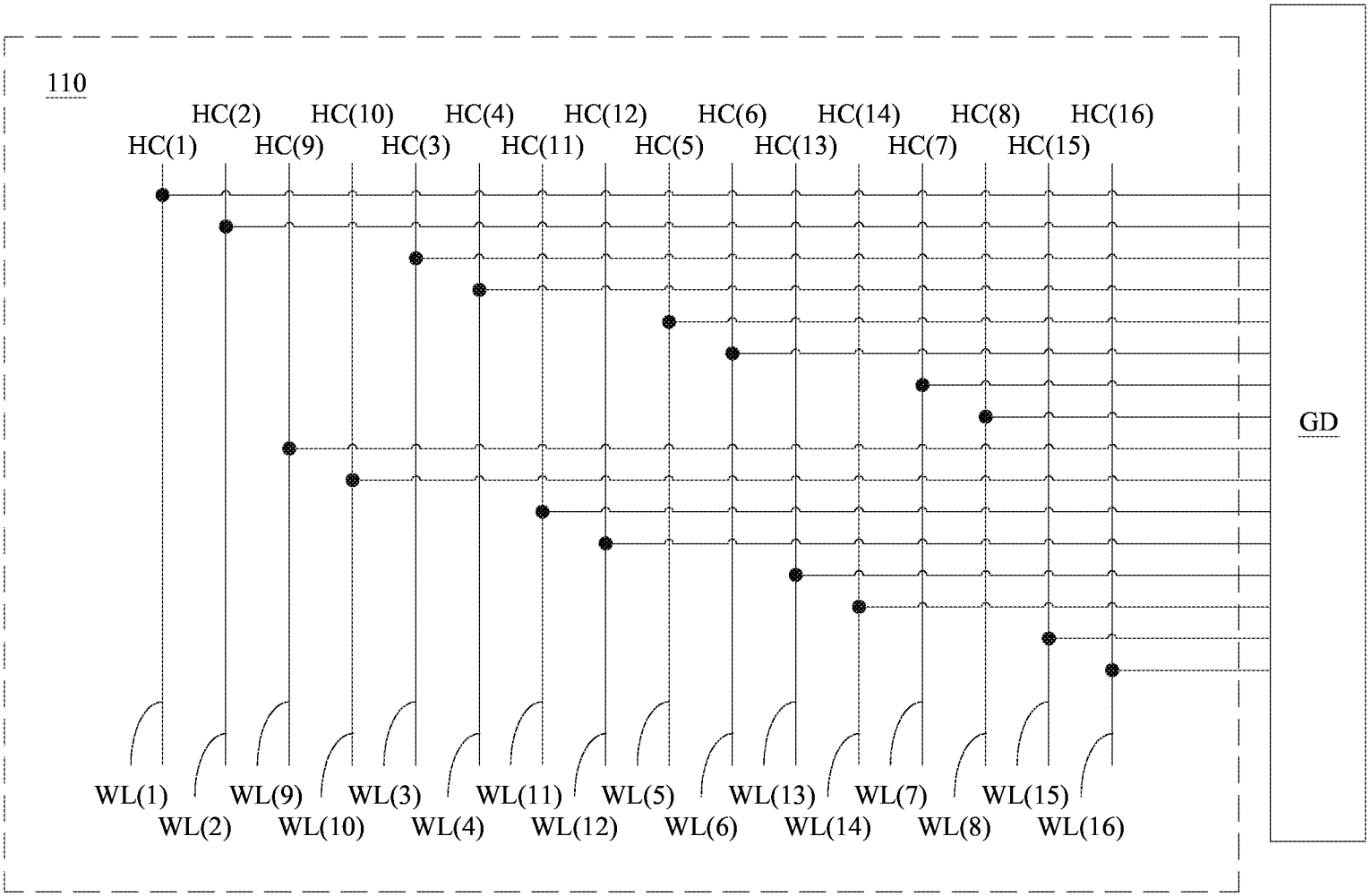
FIG. 6 is a schematic view of another embodiment of the wire component of the invention.

With the embodiments of FIG. 5 and FIG. 6, the standard deviations calculated by the ratio of fall time between the working signals HC(1) to HC(16) are reduced to 3.65% and 3.74%, respectively. That is, the coupling effect of the working signals HC(1) to HC(16) can be significantly reduced, and the problem of bright and dark lines can be alleviated.

Figure 7:
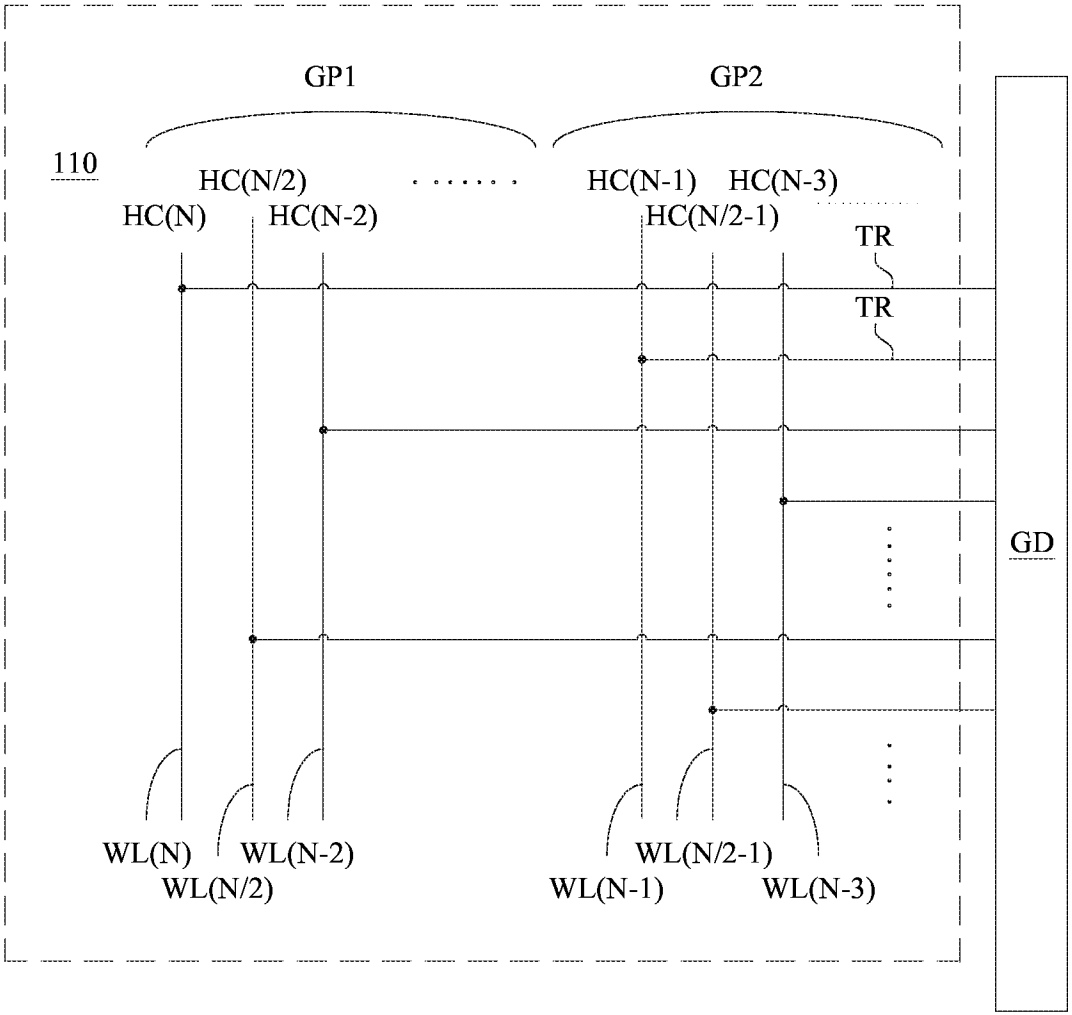
FIG. 7 is a schematic view of another embodiment of the wire component of the invention.

Referring to FIG. 7, in an embodiment, the working signal lines WL(1) to WL(N) can be divided into two groups GP1 and GP2. The group GP1 includes the working signal lines WL(N), WL(N/2), WL(N−2), . . . , etc., and the group GP2 includes the working signal lines WL(N−1), WL(N/2-1), WL(N−3), . . . , etc.

Figure 8:
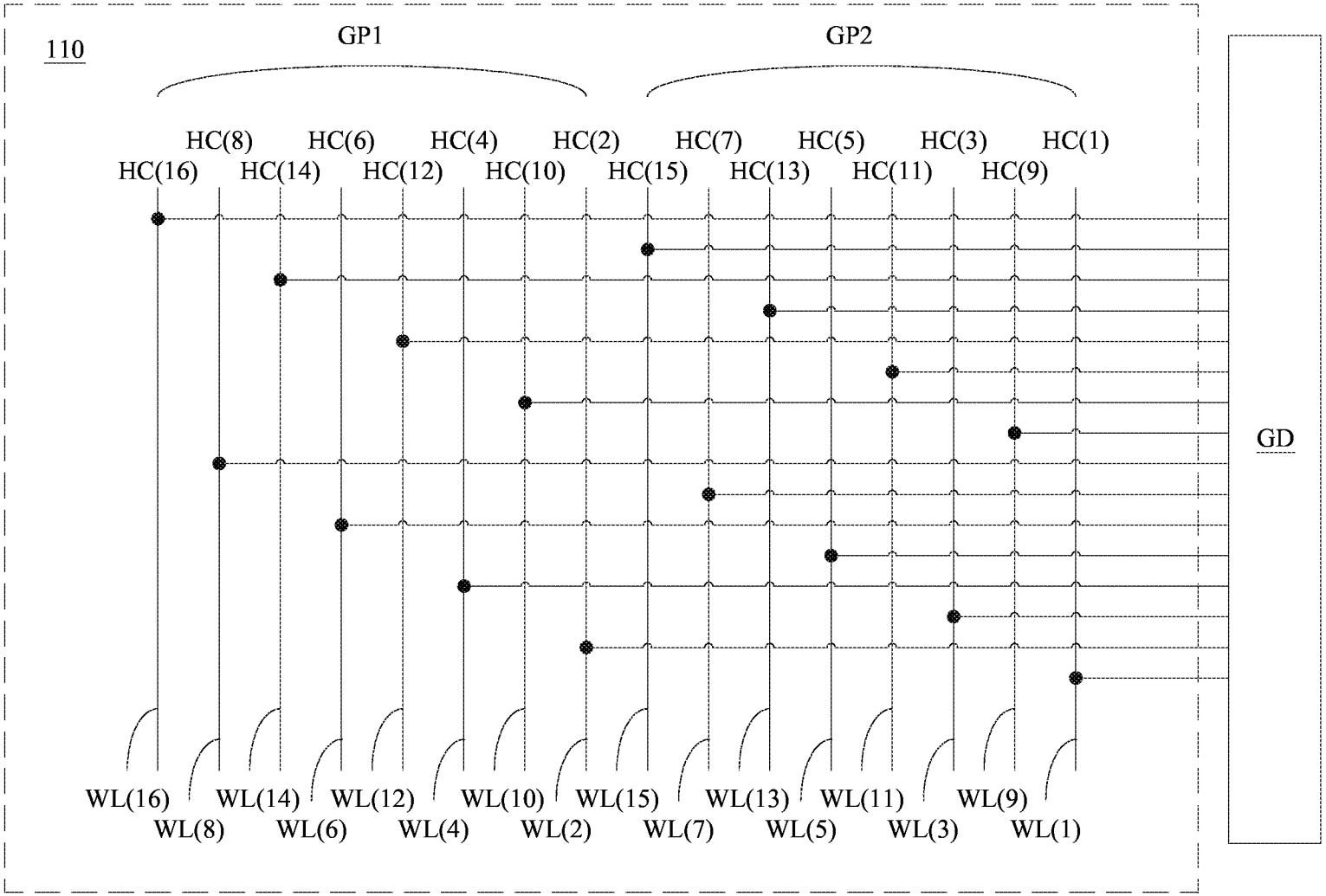
FIG. 8 is a schematic view of another embodiment of the wire component of the invention.

Taking the embodiment of FIG. 8 as an example, the group GP1 includes the working signal lines WL(16), WL(8), WL(14), WL(6), WL(12), WL(4), WL(10), and WL(2), and the group 2 includes the working signal lines WL(15), WL(7), WL(13), WL(5), WL(11), WL(3), WL(9), and WL(1). In an embodiment, in any one of the groups GP1 and GP2, the working signal lines thereof are disposed adjacent to each other. For example, the working signal lines WL(16), WL(8), WL(14), WL(6), WL(12), WL(4), WL(10), and WL(2) are disposed adjacent to each other in an area away from the gate driver GD, and the working signal lines WL(15), WL(7), WL(13), WL(5), WL(11), WL(3), WL(9), and WL(1) are disposed adjacent to each other in an area near the gate driver GD.

In this embodiment, the working signal lines WL(16) and WL(15) are separated by 7 working signal lines WL(8), WL(14), WL(6), WL(12), WL(4), WL(10), and WL(2); the working signal lines WL(8) and WL(7) are separated by 7 working signal lines WL(14), WL(6), WL(12), WL(4), WL(10), WL(2), and WL(15). Moreover, the phases of the working signals HC(16) and HC(8) respectively provided by the adjacent working signal lines WL(16) and WL(8) are substantially opposite to each other. With such a configuration, the coupling effect of the working signals HC(1) to HC(16) can be reduced.

In the case that every two working signals of the working signals HC(1) to HC(16) are sequentially same in phase (as the configuration shown in FIG. 2), in any one of the groups GP1 and GP2, the working signals provided by the working signal lines thereof sequentially immediately lag each other. For example, the working signals HC(16), HC(14), HC(12), HC(10), HC(8), HC(6), HC(4), and HC(2) sequentially immediately lag each other. In addition, the working signal lines providing the working signals having the same phase are belonged to different groups GP1 and GP2. For example, the working signal line WL(16) is belonged to the group GP1, and the working signal line WL(15) is belonged to the group GP2; the working signal line WL(2) is belonged to the group GP1, and the working signal line WL(1) is belonged to the group GP2.

In the case that the phases of the working signals HC(1) to HC(16) sequentially immediately lag each other (as the configuration shown in FIG. 3), the working signal lines corresponding to two immediately lagged working signals are belonged to different groups GP1 and GP2. For example, the working signal line WL(16) is belonged to the group GP1, and the working signal line WL(15) is belonged to the group GP2; the working signal line WL(2) is belonged to the group GP1, and the working signal line WL(1) is belonged to the group GP2.

Figure 9:
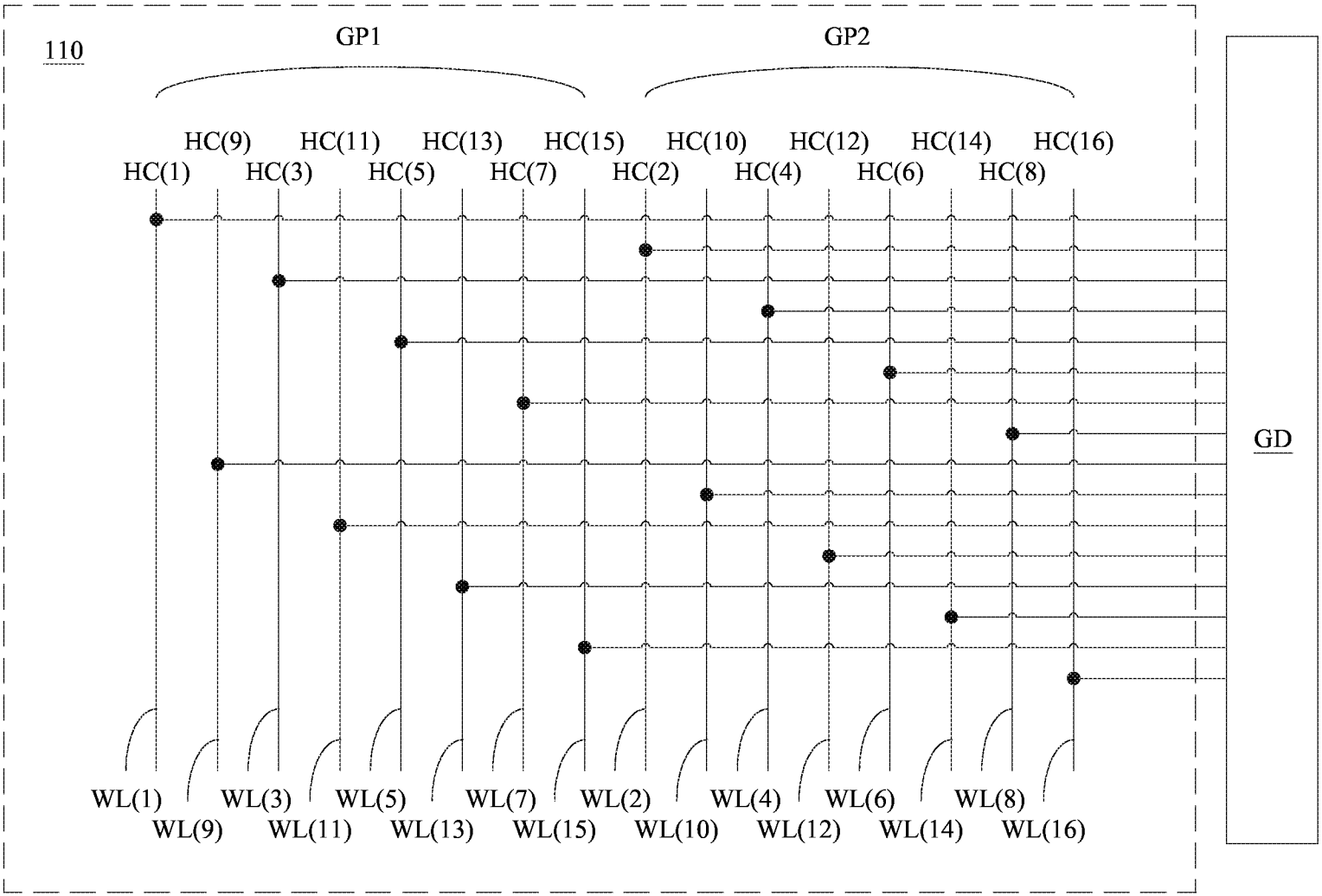
FIG. 9 is a schematic view of another embodiment of the wire component of the invention.

In the embodiment of FIG. 8, the working signal line WL(1) is arranged neighboring the gate driver GD, and the working signal line WL(16) is arranged far away from the gate driver GD, but not limited thereto. As shown in FIG. 9, in another embodiment, the working signal line WL(1) can be arranged far away from the gate driver GD, and the working signal line WL(16) is arranged neighboring the gate driver GD.

With the embodiments of FIG. 8 and FIG. 9, the standard deviations calculated by the ratio of fall time between the working signals HC(1) to HC(16) are reduced to 2.33% and 2.36%, respectively. That is, compared to the standard deviation of 9.66%, the coupling effect of the working signals HC(1) to HC(16) can be significantly reduced, and the problem of bright and dark lines can be alleviated.

Figure 10:
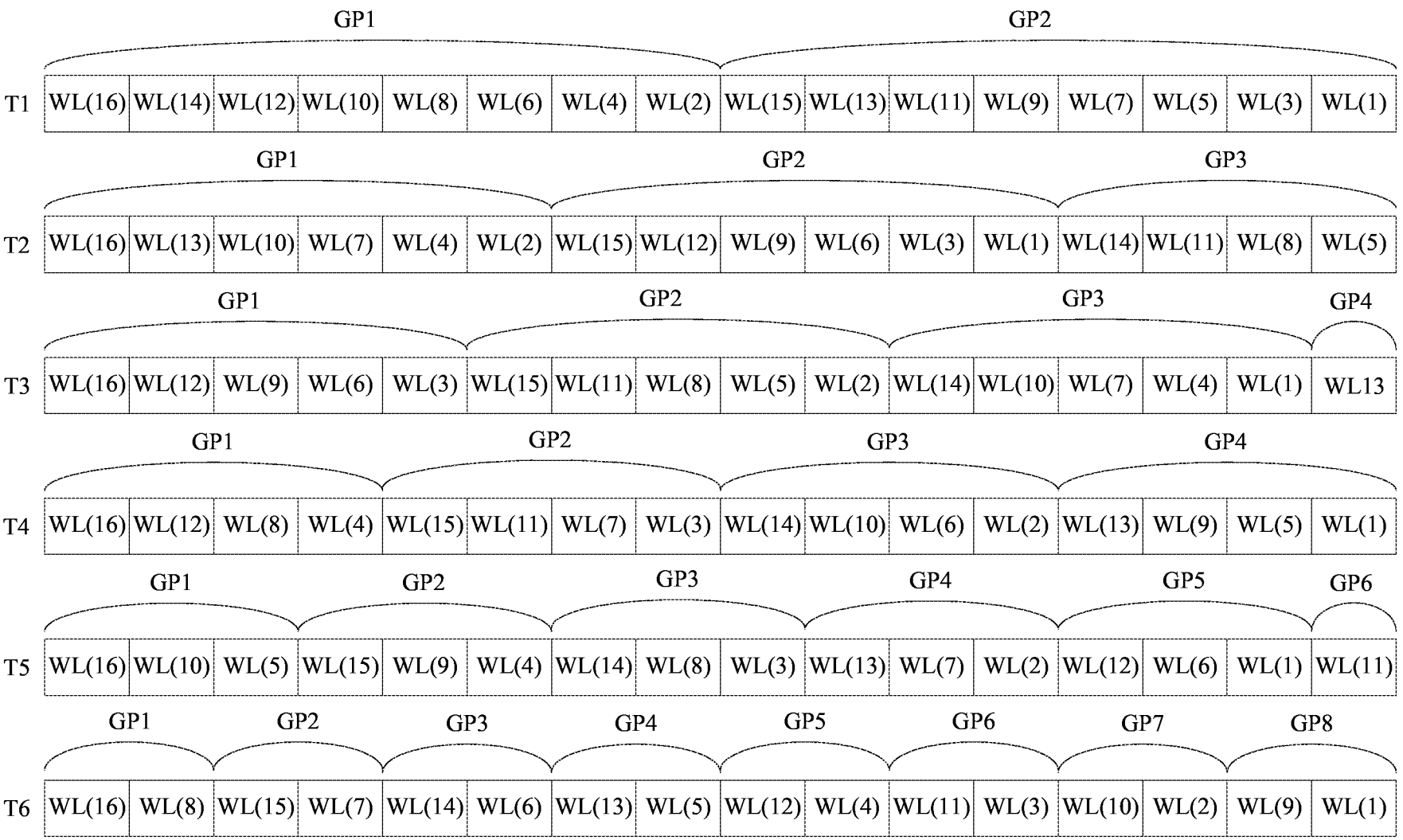
FIG. 10 is a schematic view of various embodiments of the arrangement of the working signal lines of the invention.

Referring to FIG. 10, Table T1 illustrates the arrangement of the working signal lines WL(1) to WL(16) divided into two groups GP1 and GP2 in an embodiment; Table T2 illustrates the arrangement of the working signal lines WL(1) to WL(16) divided into three groups GP1 to GP3 in an embodiment; Table T3 illustrates the arrangement of the working signal lines WL(1) to WL(16) divided into four groups GP1 to GP4 in an embodiment; Table T4 illustrates the arrangement of the working signal lines WL(1) to WL(16) divided into four groups GP1 to GP4 in another embodiment; Table T5 illustrates the arrangement of the working signal lines WL(1) to WL(16) divided into six groups GP1 to GP6 in an embodiment; Table T6 illustrates the arrangement of the working signal lines WL(1) to WL(16) divided into eight groups GP1 to GP8 in an embodiment.

In Tables T1 to T6 of FIG. 10, the leftmost working signal line represents the farthest position away from the gate driver GD, and the second leftmost working signal line represents the second farthest position away from the gate driver GD, and so on. In another embodiment, the rightmost working signal line represents the closest position to the gate driver GD, and the second rightmost working signal line represents the second closest position to the gate driver GD, and so on.

In an embodiment, the total number of the working signal lines WL(1) to WL(N) is N. Taking G working signal lines as a group, N is divided by G to obtain m groups, wherein N and G are positive integers. In an embodiment, the number of working signal lines (N) may not be exactly divided by the number of working signal lines for one group (G) without remainder. In the case that N is divided by G to obtain the quotient of m and the remainder of 0, the number of groups is m, and each group has G working signal lines. In the case that N is divided by G to obtain the quotient of m and the remainder of P, the number of groups is m+1, wherein m is an integer larger than 1, and P is an integer equal to or larger than 1 and less than G. Each group has a same arrangement.

With the embodiments of Tables T1 to T6 shown in FIG. 10, the standard deviations calculated by the ratio of fall time between the working signals HC(1) to HC(16) are reduced to 5.20%, 6.49%, 6.23%, 2.78%, 6.26%, and 3.65%, respectively. Compared to the standard deviation of 9.66%, the coupling effect of the working signals HC(1) to HC(16) can be significantly reduced, and the problem of bright and dark lines can be alleviated.

Figure 11:
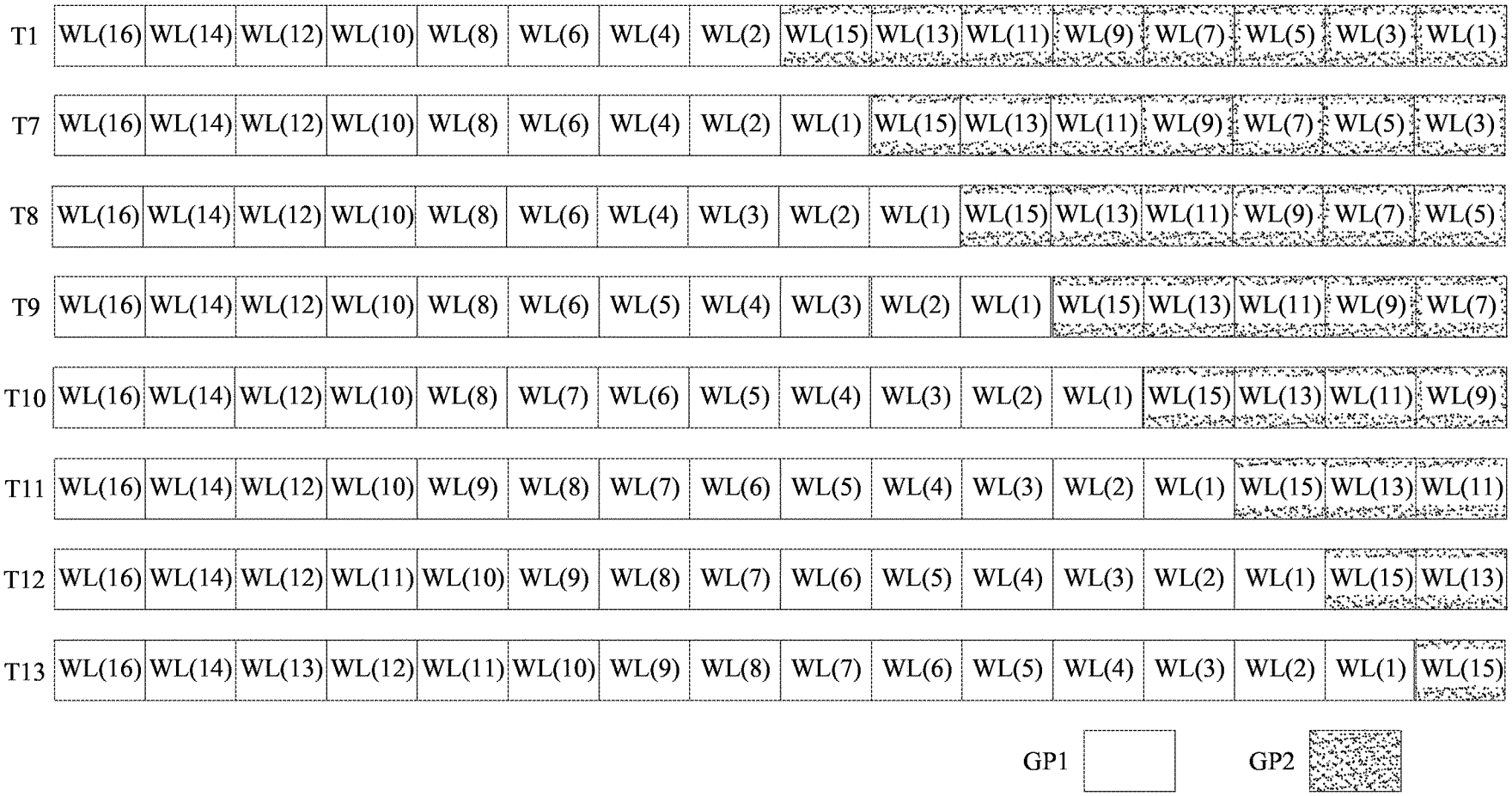
FIG. 11 is a schematic view of various embodiments of the arrangement of the working signal lines of the invention.

Referring to FIG. 11, in Tables T1, T7 to T13, the working signal lines WL(1) to WL(16) are divided into two groups GP1 and GP2, and the groups GP1 and GP2 include different numbers of the working signal lines WL(1) to WL(16).

With the embodiments of Tables T7 to T13 shown in FIG. 11, the standard deviations calculated by the ratio of fall time between the working signals HC(1) to HC(16) are reduced to 5.20%, 5.24%, 4.72%, 5.11%, 6.40%, 7.95%, and 8.75%, respectively. Compared to the standard deviation of 9.66%, the coupling effect of the working signals HC(1) to HC(16) can be significantly reduced, and the problem of bright and dark lines can be alleviated.

From the embodiments of FIG. 10 and FIG. 11, the coupling effect of the working signals HC(1) to HC(16) can be reduced by dividing the working signal lines WL(1) to WL(16), which correspond to the working signals HC(1) to HC(16) having phases at least partially immediately lag each other, into different numbers of groups and distributing separately, or by modifying the number of working signal lines in individual groups, but not limited thereto. Any possible arrangements of the working signal lines WL(1) to WL(16) that the working signal lines corresponding to the working signals, which have a same phase or have phases immediately lag each other, are arranged with another working signal line(s) therebetween is within the scope of the invention.

Although the preferred embodiments of the present invention have been described herein, the above description is merely illustrative. The preferred embodiments disclosed will not limit the scope of the present invention. Further modification of the invention herein disclosed will occur to those skilled in the respective arts and all such modifications are deemed to be within the scope of the invention as defined by the appended claims.

What is claimed is:

1. A display device, comprising:

a gate driver configured to provide a plurality of gate signals to a plurality of pixel driving circuits according to a plurality of working signals, wherein phases of the working signals at least partially lag each other sequentially;

a plurality of working signal lines arranged substantially parallel to each other and configured to respectively provide the working signals; and a plurality of transmitting lines respectively connected between the working signal lines and the gate driver and configured to transmit the working signals to the gate driver, wherein a portion of the transmitting lines crosses the working signal lines, wherein a first working signal line of the working signal lines is configured to provide a first working signal of the working signals, a second working signal line of the working signal lines is configured to provide a second working signal of the working signals, the first working signal immediately lags the second working signal, and the first working signal line and the second working signal line are arranged with a third working signal line of the working signal lines therebetween;

wherein a first transmitting line of the transmitting lines corresponding to the first working signal line is arranged adjacent to a second transmitting line of the transmitting lines corresponding to the second working signal line; the second transmitting line is arranged between the first transmitting line and a third transmitting line of the transmitting lines corresponding to the third working signal line.

2. The display device of claim 1, wherein the third working signal line of the working signal lines is configured to provide a third working signal of the working signals; the third working signal and the second working signal are same in phase, and the third working signal line and the second working signal line are arranged adjacent to each other.

3. The display device of claim 1, wherein every two working signals of the working signals are sequentially same in phase, and the first working signal line and the second working signal line are arranged with another two working signal lines therebetween.

4. The display device of claim 1, wherein a fourth working signal line of the working signal lines is configured to provide a fourth working signal of the working signals; the phases of the first working signal and the fourth working signal are substantially opposite to each other, and the first working signal line and the fourth working signal line are arranged adjacent to each other.

5. The display device of claim 1, wherein the working signal lines are divided into a plurality of groups; the working signal lines in one of the groups are arranged adjacent to each other, and the working signals corresponding to the working signal lines in the one of the groups are sequentially immediately lag each other.

6. The display device of claim 1, wherein a fifth working signal line of the working signal lines is configured to provide a fifth working signal, the phases of the first working signal and the fifth working signal are the same, and the first working signal line and the fifth working signal line are arranged with another working signal line of the working signal lines therebetween.

7. The display device of claim 1, wherein the working signal lines are divided into a plurality of groups; the working signal lines in one of the groups are arranged adjacent to each other, and the first working signal line and the second working signal line are belonged to different groups.

8. The display device of claim 1, wherein the number of the working signal lines is N; taking G working signal lines as a group, N is divided by G to obtain a quotient of m and a remainder of P; when P equals to 0, the number of groups is m, and each group has a same arrangement; when P is equal to or larger than 1, the number of groups is m+1.

9. The display device of claim 1, wherein the working signals are same in waveform.

10. A wire component, comprising:

a plurality of working signal lines configured to respectively provide a plurality of working signals to a driving circuit, wherein phases of the working signals at least partially lag each other sequentially; and a plurality of transmitting lines configured to respectively transmit the working signals, wherein a portion of the transmitting lines crosses the working signal lines, wherein a first working signal line of the working signal lines is configured to provide a first working signal of the working signals, a second working signal line of the working signal lines is configured to provide a second working signal of the working signals, the first working signal immediately lags the second working signal, and the first working signal line and the second working signal line are arranged with a third working signal line of the working signal lines therebetween;

wherein a first transmitting line of the transmitting lines corresponding to the first working signal line is arranged adjacent to a second transmitting line of the transmitting lines corresponding to the second working signal line; the second transmitting line is arranged between the first transmitting line and a third transmitting line of the transmitting lines corresponding to the third working signal line.

11. The wire component of claim 10, wherein the third working signal line of the working signal lines is configured to provide a third working signal of the working signals; the phases of the third working signal and the second working signal are the same, and the third working signal line and the second working signal line are arranged adjacent to each other.

12. The wire component of claim 10, wherein every two working signals of the working signals are sequentially same in phase, and the first working signal line and the second working signal line are arranged with another two working signal lines therebetween.

13. The wire component of claim 10, wherein a fourth working signal line of the working signal lines is configured to provide a fourth working signal of the working signals; the phases of the first working signal and the fourth working signal are substantially opposite to each other, and the first working signal line and the fourth working signal line are arranged adjacent to each other.

14. The display device of claim 10, wherein the working signal lines are divided into a plurality of groups; the working signal lines in one of the groups are arranged adjacent to each other, and the working signals corresponding to the working signal lines in the one of the groups are sequentially immediately lag each other.

15. The wire component of claim 10, wherein a fifth working signal line of the working signal lines is configured to provide a fifth working signal, the first working signal and the fifth working signal are same in the phase, and the first working signal line and the fifth working signal line are arranged with another working signal line of the working signal lines therebetween.

16. The wire component of claim 10, wherein the working signal lines are divided into a plurality of groups; the working signal lines in one of the groups are arranged adjacent to each other, and the first working signal line and the second working signal line are belonged to different groups.

17. The wire component of claim 10, wherein the number of the working signal lines is N; taking G working signal lines as a group, N is divided by G to obtain a quotient of m and a remainder of P; when P equals to 0, the number of groups is m, and each group has a same arrangement; when P is equal to or larger than 1, the number of groups is m+1.

18. The wire component of claim 10, wherein the working signals are same in waveform.

19. A display device, comprising:

a plurality of working signal lines configured to respectively provide a plurality of working signals to a driving circuits, wherein phases of the working signals at least partially lag each other sequentially; and a plurality of transmitting lines configured to respectively transmit the working signals, wherein a portion of the transmitting lines crosses the working signal lines, wherein a first working signal line of the working signal lines is configured to provide a first working signal of the working signals, a second working signal line of the working signal lines is configured to provide a second working signal of the working signals, the phases of the first working signal and the second working signal are the same, and the first working signal line and the second working signal line are arranged with a third working signal line of the working signal lines therebetween;

wherein a first transmitting line of the transmitting lines corresponding to the first working signal line is arranged adjacent to a second transmitting line of the transmitting lines corresponding to the second working signal line; the second transmitting line is arranged between the first transmitting line and a third transmitting line of the transmitting lines corresponding to the third working signal line.

20. The display device of claim 19, wherein the third working signal line of the working signal lines is configured to provide a third working signal of the working signals; the phases of the third working signal and the first working signal are substantially opposite to each other, and the third working signal line and the first working signal line are arranged adjacent to each other.

* * * * *